US006105729A

United States Patent [19]

Nakamori et al.

[11] Patent Number: 6,105,729

[45] Date of Patent: Aug. 22, 2000

[54] ELEVATOR CAR OPERATING PANEL

[75] Inventors: Masanori Nakamori, Yokohama; Shunsuke Tanaka, Kawasaki, both of Japan

[73] Assignee: Otis Elevator Company, Farmington, Conn.

[21] Appl. No.: 09/266,115

[22] Filed: Mar. 11, 1999

[30] Foreign Application Priority Data

Mar. 30, 1998 [JP] Japan ..... 10-083052

[51] Int. Cl.[7] ..... B66B 3/00

[52] U.S. Cl. ..... 187/391; 187/901

[58] Field of Search ..... 187/380, 377, 187/384, 388, 391, 393, 395, 901; 340/464, 944, 525, 691.6, 825.19

[56] References Cited

U.S. PATENT DOCUMENTS

| | | | |
|---|---|---|---|
| 3,705,640 | 12/1972 | Eastcott | 187/29 R |
| 4,441,034 | 4/1984 | Iten | 187/29 R |
| 4,678,062 | 7/1987 | Sumka | 187/130 |
| 5,329,078 | 7/1994 | Gustafson | 187/136 |
| 5,390,766 | 2/1995 | Martin | 187/396 |
| 5,821,479 | 10/1998 | Kondo et al. | 187/395 |

*Primary Examiner*—Jonathan Salata

[57] ABSTRACT

An elevator car operating panel (8), for a visually impaired passenger includes an upper floor input button (9), a lower floor input button (10) and an input confirmation button (11).

3 Claims, 2 Drawing Sheets

ELEVATOR CAR OPERATING PANEL

TECHNICAL FIELD

The present invention pertains to an elevator car control panel that enables a visually impaired person to select a destination floor when he utilizes an elevator.

BACKGROUND OF THE INVENTION

In utilizing an elevator, a passenger has entered an elevator car arriving at a platform, pressed a destination floor button of an elevator car control panel installed on a wing wall of an elevator car, and selected a destination floor. Here, the destination floor button of the elevator car control panel corresponds only to the number of the destination floor, and the destination floor is displayed on the button. The destination floor is registered in the elevator car control panel by pressing the button, on which the destination floor is displayed, while observing with the eyes. A command is output to a driving means such as lift motor from the elevator car control panel, and the elevator car moves to the destination floor selected.

DISCLOSURE OF THE INVENTION

In the elevator car control panel of such a conventional elevator, since the floor destination button installed in it is pressed while observing with the eyes, it is most easily used for passengers without a visual impairment. However, in order for a visually impaired person to select a destination floor, an intended destination floor button had to be searched while touching many destination floor buttons with the fingers, and such a search was difficult. Also, even if the destination floor button was pressed, whether or not it was the intended floor was not clear.

The purpose of the present invention is to enable a visually impaired person to select a destination floor.

BEST MODE FOR CARRYING OUT THE INVENTION

Figure 1:
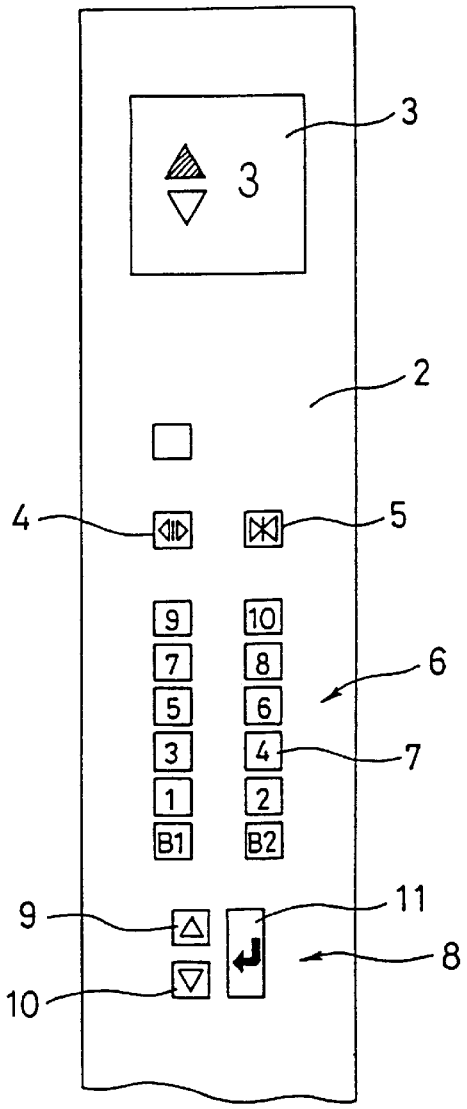
FIG. 1 is a front view showing an application example of the elevator car control panel of an elevator of the present invention.

According to the present invention, a car operating panel is provided, including an upper floor input button (9) for inputting the destination floor above the current floor by means of the number of pushes; lower floor input button (10) for inputting the destination floor below the current floor by means of the number of pushes; confirmation button (I 1) which is pushed to register the input destination floor; electronic buzzer (13) which rings to indicate the registered destination floor; and control unit (12) which, upon input of the signal from the upper floor input button or lower floor input button and the signal from the confirmation button, outputs a command of registration of the destination floor to car controller (14) and outputs a driving signal to the electronic buzzer to indicate the registered destination floor.

DETAILED DESCRIPTION

Figure 2:
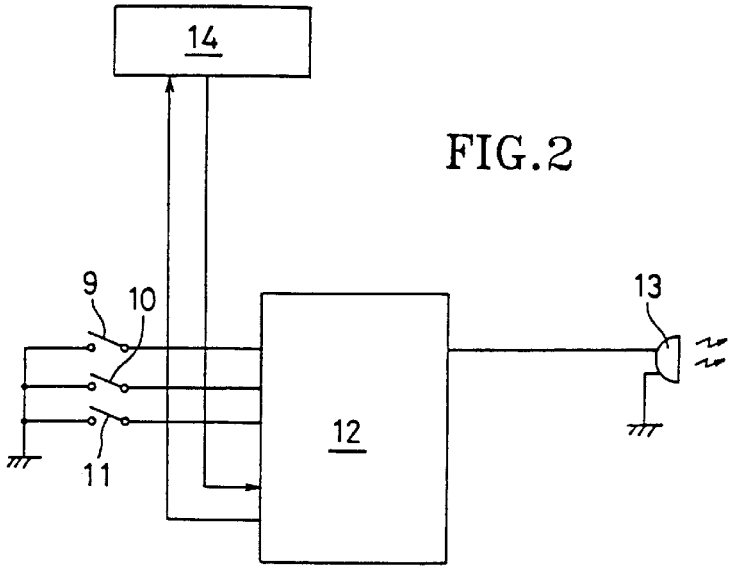
FIG. 2 is its block diagram.
Figure 3:
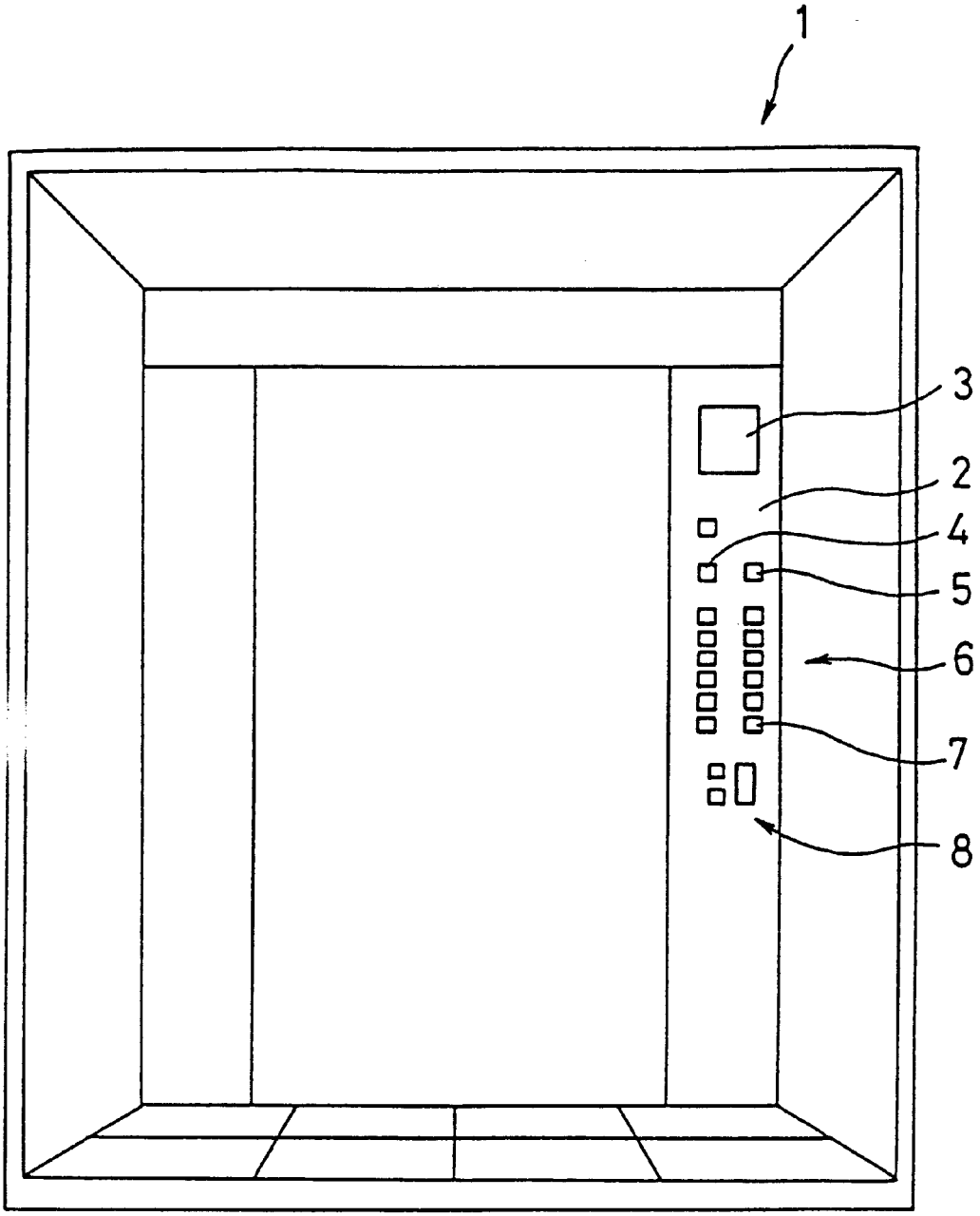
FIG. 3 is a front view of an elevator car.

Next, the present invention is explained based on the figures. FIGS. 1–3 show an application example of the elevator car control panel of an elevator of the present invention.

In FIG. 3, 1 is an elevator car, and elevator car position and direction indicator 3, door opening button 4, and door closing button 5 are installed at a wing wall 2 of the elevator car 1. Also, at the wing wall 2, an elevator car control panel 6 for selecting a destination floor is installed, and the housing of the elevator car control panel 6 is integrated with the wing wall. Also, the elevator car control panel 6 has destination floor buttons 7 corresponding in number to each floor. The above-mentioned elevator car control panel 6 is used by visually unimpaired passengers and pressed while observing the destination floor button 7, on which floors are displayed, with the eyes in order to select a destination floor, as is conventional.

As shown in FIG. 1, an elevator car control panel 8 for visually impaired persons is installed in addition to and below the conventional elevator car control panel 6, and the housing of the elevator car control panel 8 is also integrated with the wing wall 2. The elevator car control panel 8 has upper floor input button 9, lower floor input button 10, and confirmation button 11. On the upper floor input button 9, a regular triangular projection is formed, and on the lower floor input button 10, an inverted triangular projection is formed. An arrow-shaped projection is formed on the confirmation button 11.

The upper floor input button 9 selects an upper floor (that is, above ground floor) [counted] from the first floor (ground floor) when a destination floor is selected, and the number of times pressed becomes selection of the destination floor.

For example, if the upper floor input button is pressed five times, the fifth floor above ground is selected as a destination floor. The lower floor input button 10 selects a lower floor (that is, underground floor) [counted] from the first floor, and the number of times button 10 is pressed becomes a selection of the destination underground floor. The confirmation button 11 confirms the destination floor input by the upper and lower floor input buttons 9 and 10, and registers the destination floor when it is correct.

As shown in FIG. 2, the upper and lower floor input buttons 9 and 10 and the confirmation button 11 are connected to a one-chip microcomputer 12 (control part), and an electronic buzzer 13 is connected to the one-chip microcomputer 12. The one-chip microcomputer 12 houses ROM, RAM, PIO parallel, SIO, interruption controller, clock, etc., and the one-chip microcomputer 12 and the electronic buzzer 13 are housed in the housing of elevator car control panel 8, that is, in the wing wall 2.

If the upper floor input button 9 is pressed once, its signal is output to the one-chip microcomputer 12. Furthermore, an actuation signal is output to the electronic buzzer 13 from the one-chip microcomputer 12, and the electronic buzzer 13 emits one short sound. If the lower floor input button 10 is pressed once, its signal is output to the one-chip microcomputer 12. Furthermore, an actuation signal is output to the electronic buzzer 13 from the one-chip microcomputer 12, and the electronic buzzer 13 continuously emits a series of double beeps.

The destination floor input by pressing the upper and lower floor input buttons 9 and 10 by a visually impaired person is ascertained by the number of short sounds made by electronic buzzer 13, and when the destination floor is correct, the signal for the input destination floor is registered in the elevator car controller 14 by pressing the confirmation button 11. Also, at that time, the destination floor input and confirmed is displayed on the elevator car position and direction indicator 3.

Also, the elevator car control panel 8 is intended for use by visually impaired persons; while it may also be used by any passenger.

As explained above, according to the present invention, if the signal from the upper floor input button or lower floor input button and the signal from the confirmation button are input, a destination floor registration command is output to the elevator car controller. Also, an actuation signal is output to the electronic buzzer to make it sound to announce the destination floor registered. Thus, visually impaired passengers can also select a destination floor.

Various changes to the above description may be made without departing from the spirit and scope of the present invention as would be obvious to one of ordinary skill in the art of the present invention.

What is claimed is:

1. An elevator car operating panel for entering a destination floor relative to a current floor, comprising:

an upper floor input button, responsive to a number of pushes, for entering said destination floor above the current floors, a lower floor input button, responsive to a number of pushes, for entering said destination floor below the current floor, wherein, the number of pushes of the upper and lower floor input button corresponds to the relative location of said destination floor to the current floor.

2. The elevator car operating panel as recited in claim 1, further comprising:

a control unit, responsive to pushes of the upper floor input button, lower floor input button, and confirmation button for generating a command of registration of said destination floor to a car controller.

3. The elevator car operating panel as recited in claim 2, wherein the control unit generates a driving signal for an electronic buzzer, the driving signal indicative of the destination floor.

* * * * *